US008833104B2

(12) United States Patent
Richmond

(10) Patent No.: US 8,833,104 B2
(45) Date of Patent: Sep. 16, 2014

(54) METHOD OF PROVIDING JEWELRY APPARATUS

(71) Applicant: Magnet House Jewelry, LLC, Minneapolis, MN (US)

(72) Inventor: Marianne R. Richmond, St. Anthony, MN (US)

(73) Assignee: Magnet House Jewelry, LLC, Minneapolis, MN (US)

( * ) Notice: Subject to any disclaimer, the term of this patent is extended or adjusted under 35 U.S.C. 154(b) by 0 days.

(21) Appl. No.: 13/765,483

(22) Filed: Feb. 12, 2013

(65) Prior Publication Data

US 2013/0152396 A1 Jun. 20, 2013

Related U.S. Application Data

(63) Continuation of application No. 12/364,743, filed on Feb. 3, 2009, now Pat. No. 8,371,141.

(51) Int. Cl.
*A44C 25/00* (2006.01)
*A44C 27/00* (2006.01)

(52) U.S. Cl.
CPC ..... *A44C 27/00* (2013.01); *A44D 2203/00* (2013.01); *A44C 25/002* (2013.01); *Y10S 63/90* (2013.01)
USPC ..... 63/29.2; 63/1.16; 63/23; 63/33; 63/40; 63/900; 24/303

(58) Field of Classification Search
CPC ... A44C 25/002; A44C 27/00; A44D 2203/00
USPC ..... 63/23, 29.2, 33, 40, 900; 29/896.4
See application file for complete search history.

(56) References Cited

U.S. PATENT DOCUMENTS

| | | | | |
|---|---|---|---|---|
| 2,316,225 | A | | 4/1943 | de de Hoffman et al. |
| 2,433,711 | A | | 12/1947 | Schober et al. |
| 3,553,872 | A | | 1/1971 | Ebner |
| 3,553,873 | A | | 1/1971 | Weston |
| 4,310,978 | A | * | 1/1982 | Stern ..... 40/600 |
| 4,455,719 | A | | 6/1984 | Morita |
| 4,508,156 | A | * | 4/1985 | Banks et al. ..... 164/35 |
| 4,652,239 | A | * | 3/1987 | Brimberg ..... 434/80 |
| 4,911,287 | A | * | 3/1990 | Speers ..... 206/756 |
| 4,912,944 | A | | 4/1990 | Crosley et al. |
| 4,989,299 | A | | 2/1991 | Morita |
| 5,165,257 | A | * | 11/1992 | Corenblith ..... 63/40 |
| 5,269,083 | A | | 12/1993 | Vampatella et al. |

(Continued)

OTHER PUBLICATIONS

"Get Started Pack—Large," datasheet [online]. mag-tagz designs, L.L.C., Bee Cave, TX © 2009 [retrieved on May 6, 2005]. Retrieved from the Internet:<URL:http://mag-tagz.com/getstartedpack-large.aspx>; 1 page.

(Continued)

*Primary Examiner* — Robert J Sandy
*Assistant Examiner* — Louis Mercado
(74) *Attorney, Agent, or Firm* — Mueting, Raasch & Gebhardt, P.A.

(57) ABSTRACT

Methods of providing jewelry apparatus may include providing a sheet of magnetic material and a receiving portion. The sheet of magnetic material may include a plurality of decorative insert bodies, and the receiving portion may be configured to receive a decorative insert body of the plurality of decorative insert bodies.

20 Claims, 9 Drawing Sheets

(56) References Cited

U.S. PATENT DOCUMENTS

| | | | | |
|---|---|---|---|---|
| 5,369,899 | A | 12/1994 | Reeves | |
| 5,572,887 | A | 11/1996 | Geswelli | |
| 5,647,101 | A | 7/1997 | Morita | |
| 5,769,995 | A * | 6/1998 | Greyerbiehl | 156/250 |
| 5,806,346 | A | 9/1998 | Schlinger et al. | |
| 5,974,634 | A | 11/1999 | Eisenpresser | |
| 6,422,955 | B1 | 7/2002 | Lopez | |
| 6,477,749 | B1 | 11/2002 | Reiter | |
| 6,557,377 | B1 | 5/2003 | Massari | |
| 6,594,871 | B2 | 7/2003 | Hoffman | |
| 6,632,168 | B2 | 10/2003 | Roberts et al. | |
| 7,312,388 | B2 * | 12/2007 | Oskorep | 84/322 |
| 7,409,837 | B2 * | 8/2008 | Smith | 63/40 |
| 7,707,758 | B2 * | 5/2010 | Stagg | 40/600 |
| 7,708,456 | B2 | 5/2010 | Kraus et al. | |
| 7,900,845 | B2 * | 3/2011 | Stagg | 235/493 |
| 8,371,141 | B2 | 2/2013 | Richmond | |
| 8,387,412 | B2 * | 3/2013 | O'Byrne | 63/40 |
| 2002/0139142 | A1 | 10/2002 | Marandola, Jr. | |
| 2006/0059734 | A1 * | 3/2006 | Drie | 40/110 |
| 2007/0044356 | A1 * | 3/2007 | Riordan et al. | 40/544 |
| 2007/0256342 | A1 | 11/2007 | Marquardt et al. | |
| 2008/0196284 | A1 * | 8/2008 | Stagg | 40/124.04 |
| 2010/0192631 | A1 * | 8/2010 | Richmond | 63/23 |
| 2012/0085828 | A1 * | 4/2012 | Ziegler | 235/493 |
| 2012/0131953 | A1 * | 5/2012 | Fahsel | 63/29.2 |
| 2013/0036767 | A1 * | 2/2013 | Mehta | 63/23 |

OTHER PUBLICATIONS

"Mag-tagz™ Necklace base—Large," datasheet [online]. mag-tagz designs, L.L.C., Bee Cave, TX © 2009 [retrieved on May 6, 2009]. Retrieved from the Internet:<URL:http://mag-tagz.com/mag-tagznecklacebase-1.aspx>; 1 page.

* cited by examiner

METHOD OF PROVIDING JEWELRY APPARATUS

CROSS-REFERENCE TO RELATED APPLICATION

The present application is a continuation application of U.S. patent application Ser. No. 12/364,743 filed Feb. 3, 2009 and issued on Feb. 12, 2013 as U.S. Pat. No. 8,371,141, which is incorporated herein by reference in its entirety.

BACKGROUND

The disclosure herein relates generally to jewelry apparatus and methods of providing jewelry apparatus.

Jewelry, for example, often includes ornamental structures of various kinds. Such accessories could include a precious gem or other displayable items which is allowed to hang from a necklace, be a part of a broach or a bracelet, etc. Such ornamental structures may be mounted in various manners, e.g., clips, adhesive, etc. Further various types of structures may be used to make the ornamental structures wearable such as, e.g., chains, straps, clips, etc.

SUMMARY

The disclosure herein relates generally to jewelry apparatus that includes a decorative insert body and a receiving portion that defines an opening for receiving the decorative insert body. The decorative insert body is held in position within the opening by attraction between magnetic material of the decorative insert body and ferromagnetic material of the receiving portion.

In one embodiment, the jewelry apparatus includes a decorative insert body including a magnetic material and a receiving portion defining an opening configured to receive the decorative insert body. The decorative insert body includes, a front surface including ornamentation, a rear surface located opposite the front surface, and at least one side surface forming a perimeter of the decorative insert body. The receiving portion includes a rear portion including ferromagnetic material and a frame portion. The rear portion further includes a receiving surface defining the bottom of the opening configured to contact at least a portion of the rear surface of the decorative insert body. Further, the rear portion holds the decorative insert body in position within the opening by attraction between the magnetic material of the decorative insert body and the ferromagnetic material of the rear portion. The frame portion includes a front framing surface about the perimeter of the decorative insert body when received in the opening and at least one side surface defining the opening configured to receive the decorative insert body. Further, the at least one side surface corresponds to the perimeter of the decorative insert body so as to restrict lateral movement of the decorative insert body within the opening when the decorative insert body is received therein. Still further, the ornamentation of the front surface of the decorative insert body is viewable when the decorative insert body is received within the opening defined by the receiving portion.

In another embodiment, the jewelry apparatus includes a decorative insert body including a magnetic material and a receiving portion defining an opening configured to receive the decorative insert body. The decorative insert body includes a front surface including ornamentation, a substantially flat rear surface located opposite the front surface, and at least one side surface forming a perimeter of the decorative insert body. The receiving portion includes a rear portion and a frame portion. The rear portion includes a rear support portion and a ferromagnetic portion including a ferromagnetic material. The ferromagnetic portion is positioned adjacent to the rear support portion and further includes a substantially flat receiving surface defining the bottom of the opening configured to contact at least a portion of the substantially flat rear surface of the decorative insert body. The ferromagnetic portion holds the decorative insert body in position within the opening by attraction between the magnetic material of the decorative insert body and the ferromagnetic material of the ferromagnetic portion. The frame portion includes a front framing surface about the perimeter of the decorative insert body when received in the opening and at least one side surface defining the opening configured to receive the decorative insert body. Further, the at least one side surface corresponds to the perimeter of the decorative insert body so as to restrict lateral movement of the decorative insert body within the opening when the decorative insert body is received therein. Still further, the entire front surface of the decorative insert body is viewable when the decorative insert body is received within the opening defined by the receiving portion.

In still another embodiment, the jewelry apparatus includes a plurality of decorative insert bodies formed as part of a sheet of magnetic material and a receiving portion defining an opening configured to receive a decorative insert body of the plurality of decorative insert bodies. Each decorative insert body of the plurality of decorative insert bodies includes a front surface including ornamentation, a substantially flat rear surface located opposite the front surface, and at least one side surface forming a perimeter of the decorative insert body when separated from the sheet of magnetic material. The receiving portion includes a rear portion including a ferromagnetic material and a frame portion. The rear portion includes a substantially flat receiving surface defining the bottom of the opening configured to contact at least a portion of the substantially flat rear surface of the decorative insert body. Further, the rear portion holds the decorative insert body in position within the opening by attraction between the magnetic material of the decorative insert body and the ferromagnetic material of the rear portion. The frame portion includes at least one side surface defining the opening configured to receive the decorative insert body. Further, the at least one side surface corresponds to the perimeter of the decorative insert body so as to restrict lateral movement of the decorative insert body within the opening when the decorative insert body is received therein. Still further, the ornamentation of the front surface of the decorative insert body is viewable when the decorative insert body is received within the opening defined by the receiving portion.

The above summary is not intended to describe each embodiment or every implementation of the jewelry apparatus. Advantages, together with a more complete understanding, will become apparent and appreciated by referring to the following detailed description and claims taken in conjunction with the accompanying drawings.

Figure 1:
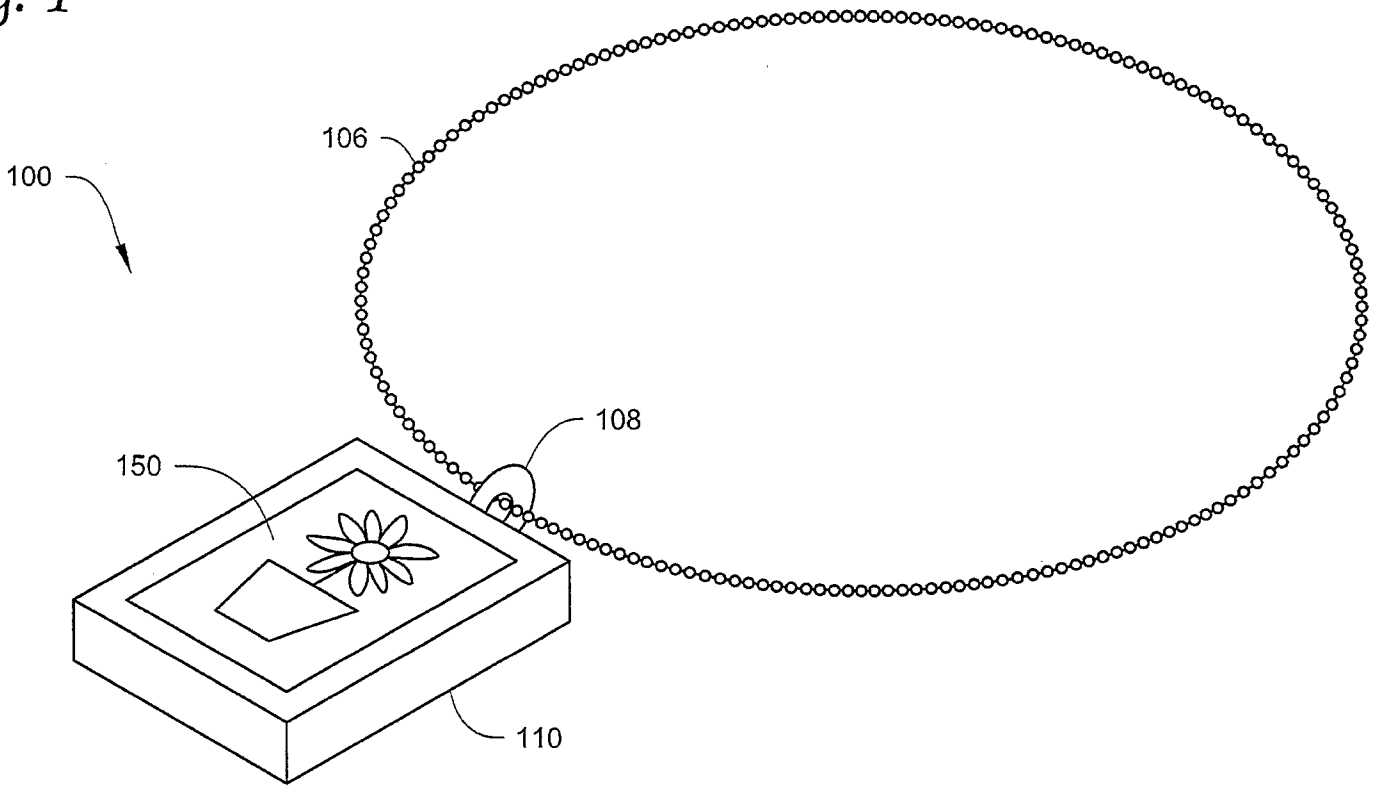
FIG. 1 is a perspective view of an exemplary embodiment of jewelry apparatus.

The figures are rendered primarily for clarity and, as a result, are not necessarily drawn to scale.

DETAILED DESCRIPTION OF EXEMPLARY EMBODIMENTS

In the following detailed description of illustrative embodiments, reference is made to the accompanying figures of the drawing which form a part hereof, and in which are shown, by way of illustration, specific embodiments which may be practiced. It is to be understood that other embodiments may be utilized and structural changes may be made without departing (e.g., still falling within) from the scope of the disclosure presented hereby.

Figure 14:
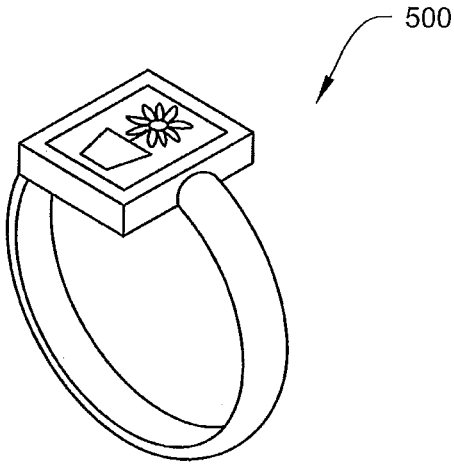
FIG. 14 is a perspective view of another exemplary embodiment of jewelry apparatus incorporated into a ring structure.
Figure 15:
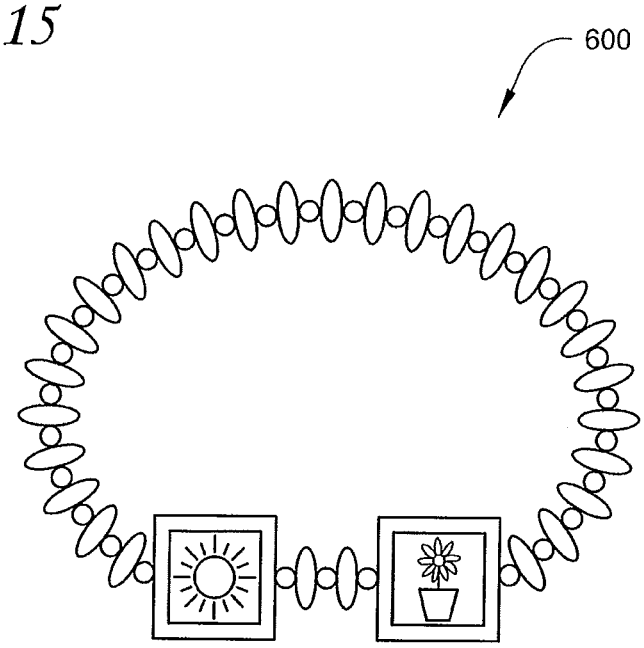
FIG. 15 is a perspective view of another exemplary embodiment of the jewelry apparatus incorporated into a bracelet.

Jewelry apparatus is shown in FIGS. 1-15. As shown in FIG. 1, jewelry apparatus 100 includes a receiving portion 110 and a decorative insert body 150. The jewelry apparatus 100 may further include a chain 106 and a loop connector 108 coupled to the receiving portion 110. In this embodiment, the chain 106 extends through the loop connector 108 for forming, e.g., a necklace. Although this embodiment includes a single loop connector 108, other embodiments may include no loop connectors (e.g., the ring embodiment of FIG. 14) or more than one loop connector depending on the configuration of the jewelry apparatus.

Figure 2:
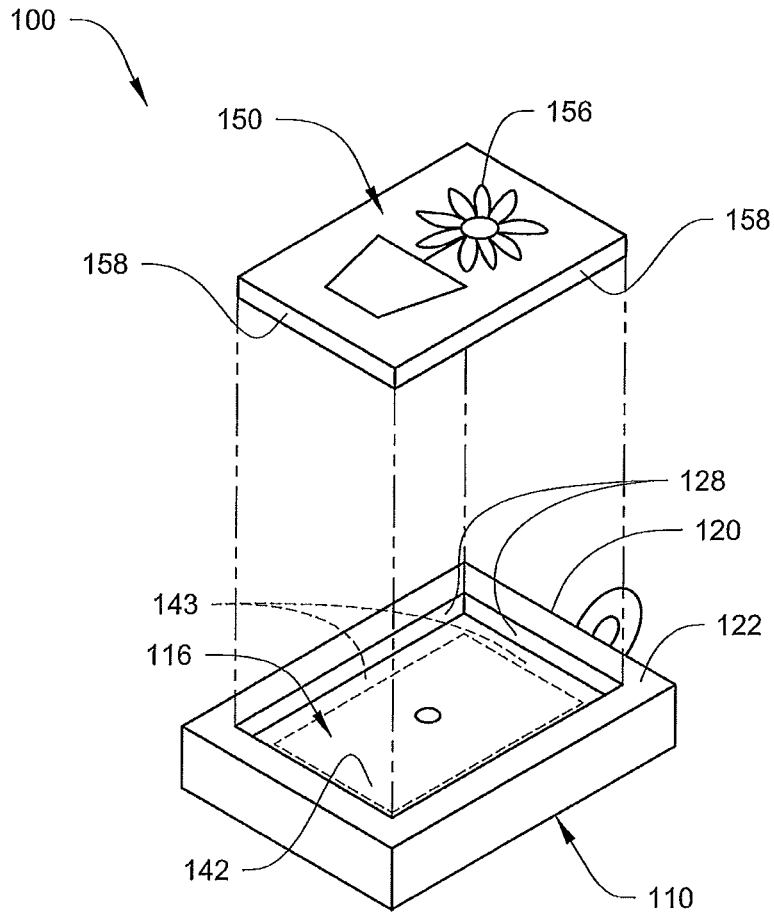
FIG. 2 is an exploded perspective view of the jewelry apparatus of FIG. 1 separating a receiving portion and a decorative insert body.

An opening 116 is defined by the receiving portion 110 configured to receive the decorative insert body 150 (see FIG. 2). The receiving portion 110 and the opening 116 in this embodiment have rectangular shapes. In other embodiments, the receiving portion 110 and/or opening 116 may be any shape, e.g., a trapezoid, oval (see FIG. 12), triangle (see FIG. 13), square (see FIG. 11), hexagon, circle, etc. For example, the receiving portion 110 and opening 116 may be an octagon. Further, the receiving portion 110 and opening 116 may not have the same shape. For example, the receiving portion 110 may be a circle while the opening 116 may be a square.

The receiving portion 110 may be formed of any material capable of defining the opening 116 to receive the decorative insert body 150. In at least one embodiment, the receiving portion 110 is formed of a non-magnetic and/or non-ferromagnetic alloy, e.g., a zinc alloy, any other metal or metal alloy, glass, rubber, polymer, ceramic, wood, etc. As further described herein, the receiving portion 110 may include multiple portions and/or materials that may be magnetic, non-magnetic, ferromagnetic, and/or non-ferromagnetic. Further, although not limited by these dimensions, the receiving portion 110 may have a width 111 of about ½ of an inch to about 6 inches, a height 113 of about ½ of an inch to about 6 inches (see FIG. 4), and a thickness of about ⅛ of an inch to about ½ of an inch.

The decorative insert body 150 includes a magnetic material. As used herein, magnetic material may be defined as material producing a magnetic field operable to attract ferromagnetic material. Further, the decorative insert body 150 defines a front surface 152, a rear surface 154 (see FIG. 9), and at least one side surface 158 (e.g., four side surfaces in this rectangular embodiment).

The front surface 152 presents ornamentation 156. In one or more embodiments, the ornamentation 156 covers the entire front surface 152. Further, in one or more embodiments, the ornamentation 156 covers a portion or multiple portions of the front surface 152. In the embodiment depicted in FIG. 1, the ornamentation 156 is a pot having a flower. The ornamentation 156, however, can be substantially anything including paintings, drawings, photographs, alphanumeric characters, holograms, colors, sculpture, symbols, logos, names, emoticons, etc. For example, the ornamentation in one or more embodiments may be two dimensional or three dimensional.

In the depicted embodiment of the decorative insert body 150, the front surface 152 and the rear surface 154 of the decorative insert body 150 are substantially flat. In other embodiments, the front surface 152 and the rear surface 154 may not be substantially flat. For example, the front surface 152 and/or the rear surface 154 may be curved to be received by a curved receiving portion 110. Further, although not limited by these dimensions, the decorative insert body 150 may have a width 153 of about ¼ of an inch to about 6 inches and a height 155 of about ¼ of an inch to about 6 inches (see FIG. 8). The decorative insert body 150 will be further described herein with reference to FIGS. 8-10.

Figure 7:
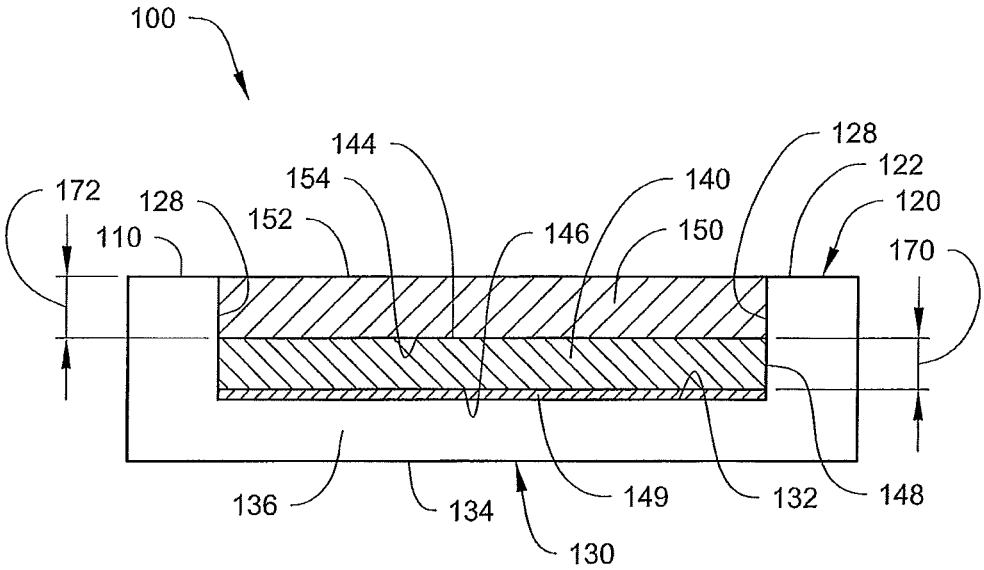
FIG. 7 is a cross-sectional view of the jewelry apparatus of FIG. 5 taken along line 7-7.
Figure 8:
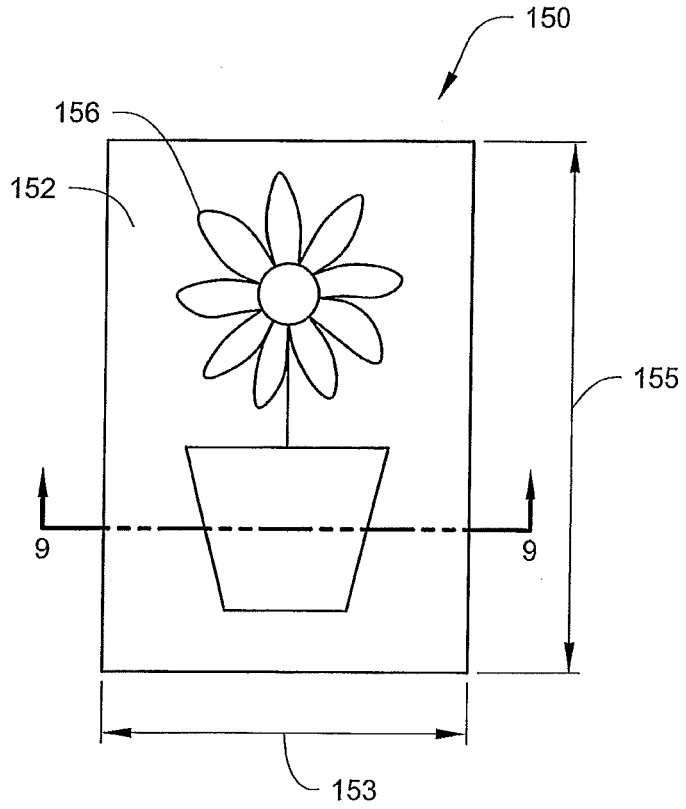
FIG. 8 is a front view of the decorative insert body of FIG. 2.

The receiving portion 110 includes a frame portion 120 and a rear portion 130 (e.g., see FIG. 7). The frame portion 120 includes a front framing surface 122 about the perimeter of the decorative insert body 150 when received in the opening 116 and at least one side surface 128 defining the opening 116 configured to receive the decorative insert body 150. In this embodiment, the front framing surface 122 is substantially flat. In other embodiments the front framing surface 122 may not be substantially flat. For example, the front framing surface 122 may be beveled outwardly or curved, or have any other shape. In one or more embodiments, the front framing surface 122 may have a width 115 of about 1/32 of an inch to about 1 inch (see FIG. 4).

Figure 3:
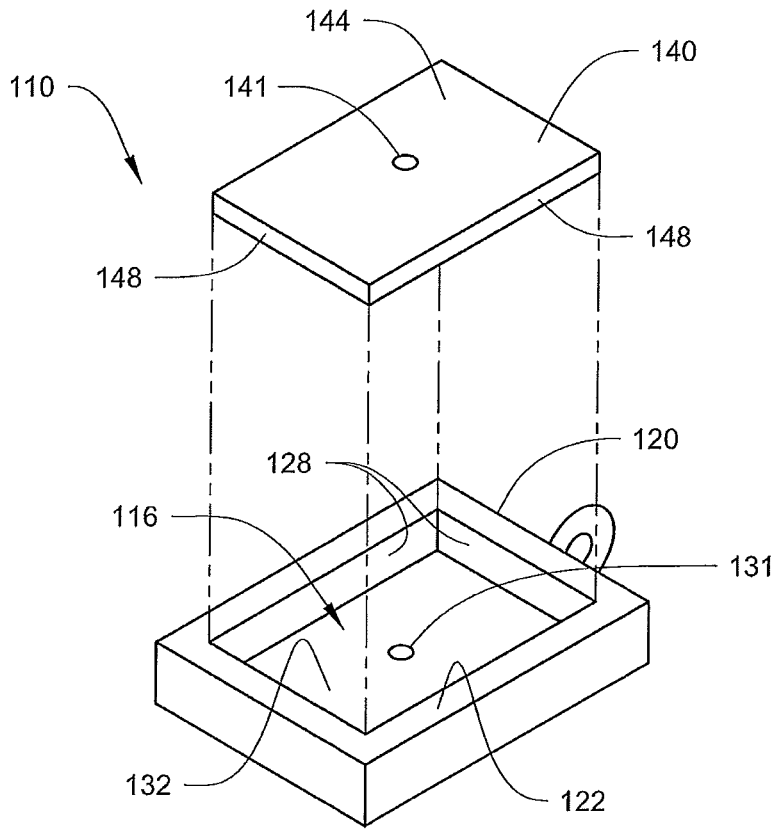
FIG. 3 is an exploded perspective view of the receiving portion of FIG. 2 showing a separate ferromagnetic portion.
Figure 4:
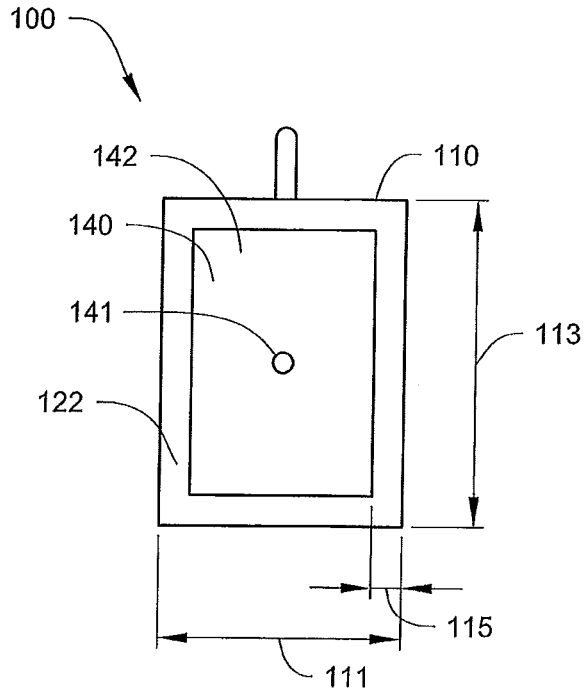
FIG. 4 is a front view of the jewelry apparatus of FIG. 1 without the decorative insert body.
Figure 5:
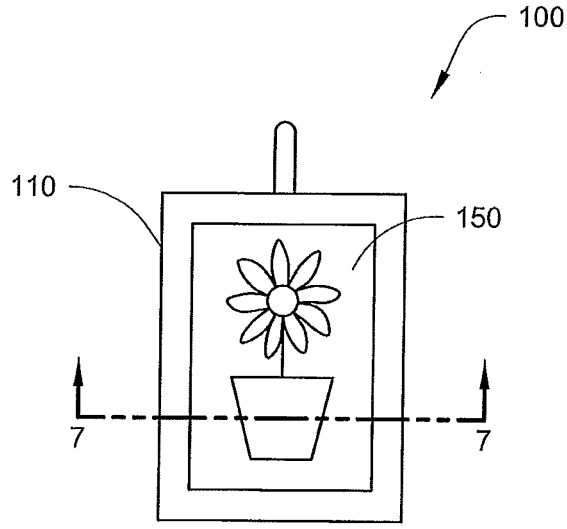
FIG. 5 is a front view of the jewelry apparatus of FIG. 1.
Figure 6:
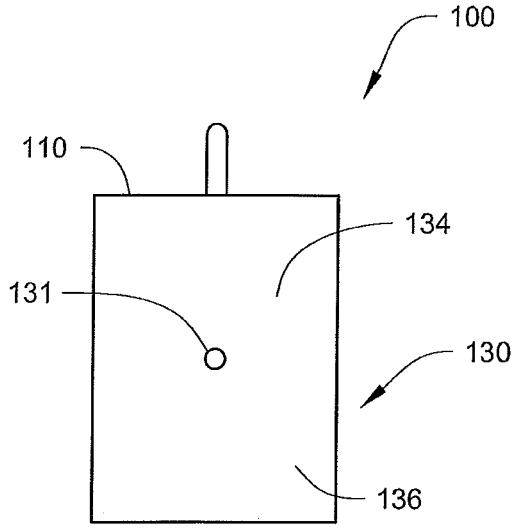
FIG. 6 is a rear view of the jewelry apparatus of FIG. 1.

Although the side surfaces 128, for example as depicted in FIG. 3, include four side surfaces defining a rectangular opening, in other embodiments, the side surfaces 128 may include more or less side surfaces depending on the shape of the opening 116. For example, the shape of the opening 116 may be a circle thereby requiring a single side surface defining the perimeter of the circle. Further, for example, the shape of the opening 116 may be an octagon thereby requiring eight side surfaces. The side surfaces 128 correspond to the perimeter of the decorative insert body 150 when the decorative insert body 150 is received therein so as to restrict lateral movement (e.g., movement perpendicular to the side surfaces 128 of the opening 116, or in other words, side-to-side movement) of the decorative insert body 150 within the opening 116. Further, the ornamentation 156 of the front surface 152 of the decorative insert body 150 is viewable when the decorative insert body 150 is received within the opening 116 defined by the receiving portion 110.

In one or more embodiments, the entire front surface 152 is viewable (i.e., fully viewable) when the decorative insert body 150 is received within the opening 116 defined by the receiving portion 110. In other words, one would be able to view the entire front surface 152 of the decorative insert body 150.

The rear portion 130 includes a ferromagnetic material. As used herein, ferromagnetic material may be defined as material that is attracted by the magnetic field produced by magnetic material. In one or more embodiments, the ferromagnetic material includes one or more metals, e.g., iron, that may be magnetized or non-magnetized. Further, in one or more embodiments, the ferromagnetic material may be magnetic material (e.g., magnetic material that is attracted to the magnetic field produced by the magnetic material of the decorative insert body 150).

The rear portion 130 further includes a receiving surface 142 defining the bottom of the opening 116 configured to contact at least a portion of the rear surface 154 of the decorative insert body 150. In the embodiment depicted, the receiving surface 142 is substantially flat. However, in one or more embodiments, the receiving surface 142 may not be substantially flat, e.g., it may be curved. Further, the rear portion 130 holds the decorative insert body 150 in position within the opening 116 by attraction between the magnetic material of the decorative insert body 150 and the ferromagnetic material of the rear portion 130.

Still further, the rear portion 130 includes a back surface 134 (see FIG. 6) opposite the receiving surface 142. An insert removal opening 131 may be defined extending therethrough the rear portion 130 from the back surface 134 to the receiving surface 142 so as to allow a person to push (e.g., with an uncoiled paperclip, a person's finger, a pen, etc.) the decorative insert body 150 out of the opening 116 after being positioned therein so as to permit the same or a different decorative insert body 150 to be received within the opening 116. Although the front framing surface 122 of the frame portion 120 and the back surface 134 of the rear portion 130 as depicted are substantially planar, in other embodiments, the surfaces 122, 134 may include contours, bevels, etc. For example, in one embodiment, the back surface 134 may be rounded (e.g., it may flow directly into or be contiguous with a side surface of the receiving portion).

In at least one embodiment, at least edge portions 143 (shown between the dotted line and the at least one side surface 128) of the receiving surface 142 proximate the at least one side surface 128 of the frame portion 120 provide a ferromagnetic interface with the rear surface 154 of the decorative insert body 150 so as to hold the decorative insert body 150 in position within the opening 116 by attraction between the magnetic material of the decorative insert body 150 and the ferromagnetic material of the rear portion 130. In at least one or more other embodiments, at least 40, 60, or 80 percent of the area of the receiving surface 142 provides a ferromagnetic interface with the rear surface 154 of the decorative insert body 150 so as to hold the decorative insert body 150 in position within the opening 116 by attraction between the magnetic material of the decorative insert body 150 and the ferromagnetic material of the rear portion 130. In at least another embodiment, substantially all of the area of the receiving surface 142 provides a ferromagnetic interface with the rear surface 154 of the decorative insert body 150 so as to hold the decorative insert body 150 in position within the opening 116 by attraction between the magnetic material of the decorative insert body 150 and the ferromagnetic material of the rear portion 130.

In the embodiment depicted, the rear portion 130 includes a rear support portion 136 (e.g., formed of non-ferromagnetic material) integral with the frame portion 120 and a ferromagnetic portion 140 positioned adjacent to the rear support portion 136 to present the receiving surface 142 defining the bottom of the opening 116. In one or more embodiments, the rear support portion 136 may not be integral with the frame portion 120 (e.g., the receiving portion may be formed of multiple sections or portions). Further, each of the frame portion 120 and the rear portion 130 may each be multiple parts or pieces. Still further, the frame portion 120 and the rear support portion 136 may be formed of non-magnetic and/or non-ferromagnetic material, e.g., a zinc alloy, any other metal or metal alloy, glass, rubber, polymer, ceramic, wood, etc., and by molding, stamping, extruding, etc.

In other words, the receiving portion 110 defining an opening 116 configured to receive the decorative insert body 150 could be described as a frame body having a surface (e.g., the front frame surface 122) and an opening extending through the surface into the frame body. Further, the opening could be sized to receive the decorative insert body 150. At least a portion of the frame body (e.g., located proximate the bottom of the opening) may include ferromagnetic material (e.g., a ferromagnetic portion 140). Still further, at least one inner side surface may form the sidewall(s) of the opening to, e.g., restrict or limit lateral or side-to-side movement of the decorative insert body 150 when located in the opening.

The ferromagnetic portion 140 may define an upper surface 144 (which, in this embodiment, presents the receiving surface 142), a lower surface 146, and at least one side surface 148. Further, the ferromagnetic portion 140 may be formed of any material capable of being ferromagnetic. In at least one embodiment, the ferromagnetic portion is formed of a Nickel-Iron (Ni—Fe) alloy. The ferromagnetic portion 140 also includes an insert removal opening 141 corresponding to the insert removal opening 131 for the same purpose as the insert removal opening 131, i.e., to allow a person to push (e.g., with an uncoiled paperclip, a person's finger, a pen, etc.) the decorative insert body 150 out of the opening 116 after being positioned therein so as to permit the same or a different decorative insert body 150 to be received within the opening 116.

The ferromagnetic portion 140 is fixed within the opening 116 of the receiving portion 110. In this embodiment, the lower surface 146 of the ferromagnetic portion 140 is adhered to a surface 132 of the rear support portion 136 with adhesive 149 (as shown in the cross-sectional view of FIG. 7). In other embodiments, the ferromagnetic portion 140 may be press-fit within the opening 116 such that the side surfaces 128 have an interference fit with the side surfaces 148 of the ferromagnetic portion 140. Further, in other embodiments, the ferromagnetic portion 140 and the rear support portion 136 (see FIG. 7) may be integral. In one or more embodiments, the rear support portion 136 may be non-ferromagnetic (e.g., formed of non-ferromagnetic material) while the ferromagnetic portion 140 is ferromagnetic (e.g., formed of ferromagnetic material). In one or more embodiments, the rear portion 130 may include ferromagnetic material without the use of a ferromagnetic section (e.g., the ferromagnetic portion 140). Further, in one or more embodiments, only a portion of the ferromagnetic portion 140 may include ferromagnetic material.

Although the ferromagnetic portion 140 in the depicted embodiment is rectangular, the ferromagnetic portion 140 may be any shape so as to provide attraction between the magnetic material of the decorative insert body 150 and the ferromagnetic portion 140 (which, in this embodiment, is the ferromagnetic material of the rear portion 130) to hold the decorative insert body 150 within the opening 116. For example, the ferromagnetic portion 140 may be "frame" shaped so as to provide at least edge portions of the receiving surface 142 proximate the at least one side surface 128 of the frame portion 120 that provides a ferromagnetic interface with the rear surface 154 of the decorative insert body 150 so as to hold the decorative insert body 150 in position within the opening 116 by attraction between the magnetic material of the decorative insert body 150 and the ferromagnetic material (e.g., the ferromagnetic portion 140) of the rear portion 130.

In at least one embodiment, the opening 116 extends into the receiving portion 110 to a depth greater than or equal to the thickness 172 of the decorative insert body 150. As such, a front surface 152 of the decorative insert body 150 may be level or sunken compared to the front framing surface 122 of the frame portion 120. In other embodiments, the opening 116 may extend into the receiving portion 110 to a depth less than the thickness of the decorative insert body 150.

A cross-sectional view of the exemplary jewelry apparatus 100 is depicted in FIG. 7. As shown, a lower surface 146 of the ferromagnetic portion 140 is adhered to the surface 132 of the rear portion 130 with adhesive 149. The ferromagnetic portion 140 may have a thickness 170 of about 1/64 of an inch to about 1/4 of an inch. The rear surface 154 of the decorative insert body 150 is in contact with the upper surface 144 of the ferromagnetic portion (which, in this embodiment, presents the receiving surface 142). The decorative insert body 150 may have a thickness 172 of about 1/64 of an inch to about 1/4 of an inch.

Figure 9:
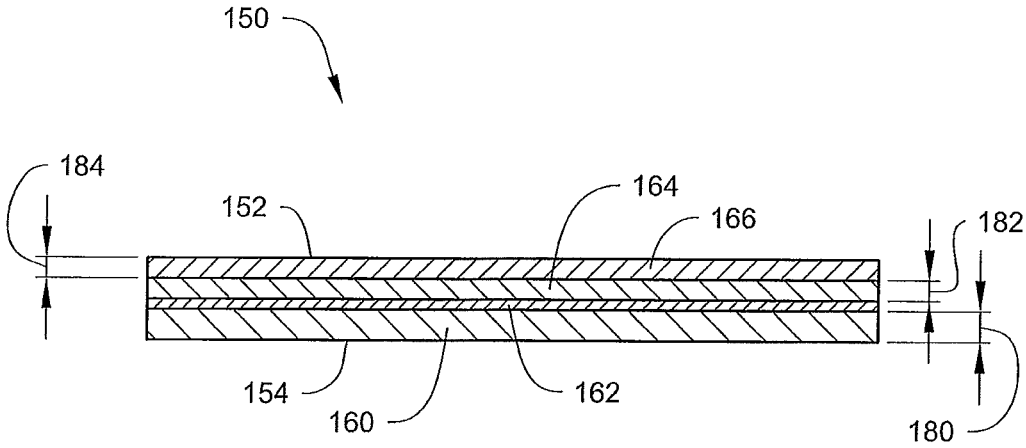
FIG. 9 is a cross-sectional view of the decorative insert body of FIG. 8 take along line 9-9.

A cross-sectional view of the exemplary decorative insert body 150 is depicted in FIG. 9. In this embodiment, the decorative insert body 150 includes four layers. The first layer 160 includes the magnetic material and may be formed of rubber, ferrite powder, polymer, and other materials. Further, the first layer 160 may have a thickness 180 of about 1/100 of an inch to about 1/4 of an inch (e.g., 0.012 inches, 0.015 inches, etc.). The second layer 162 is an adhesive layer to, e.g., adhere the first layer 160 to the third layer 164. The third layer 164 is the layer upon which the ornamentation 156 is located (e.g., printed). Further, the third layer 164 may have a thickness 182 of about 0.0020 of an inch to about 0.125 of an inch. The fourth layer 166 is a laminate layer to, e.g., protect the third layer 164. Further, the fourth layer 166 may have a thickness 184 of about 1/10,000 of an inch to about 1/100 of an inch (e.g., 0.0012 inches). In one or more embodiments, the total thickness of the decorative insert body 150 (i.e., a thickness between the front surface 152 and the rear surface 154) is about 1/64 of an inch to about 1/4 of an inch. In at least one embodiment, a depth of the opening 116 of the receiving portion 110 is equal to or greater than the thickness 172 of the decorative insert body 150 (i.e., the thickness between the front surface 152 and the rear surface 154). Although the depicted embodiment includes four layers, the decorative insert body 150 may include more or less layers depending on the configuration. For example, in at least one embodiment, the decorative insert body 150 may only include a single magnetic layer upon which ornamentation is printed. Further, although the layers of the decorative insert body 150 are described herein in a particular order, such layers may be in any order (e.g., the first layer 160 that includes the magnetic material may not be the rearmost layer).

Figure 10:
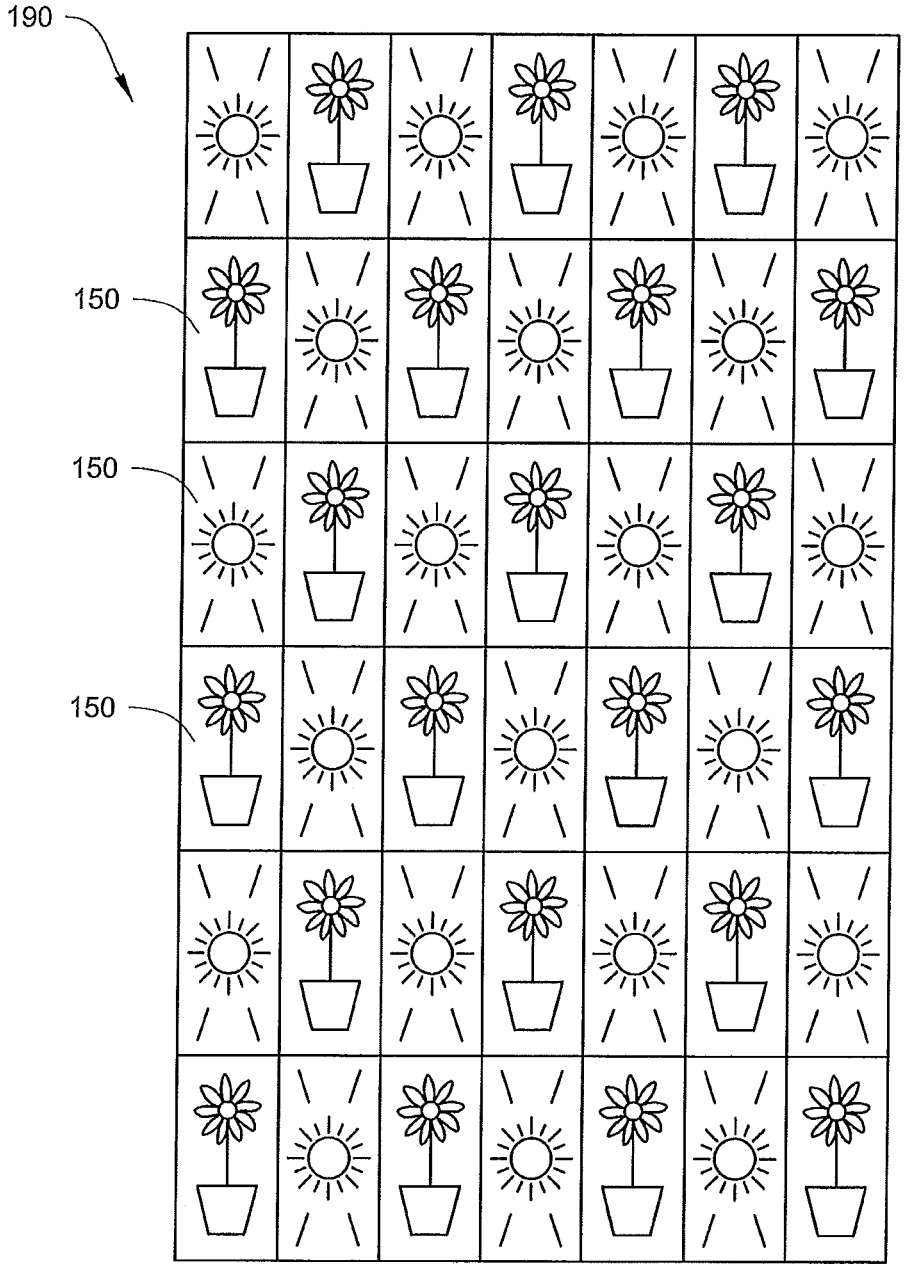
FIG. 10 is a front view of a sheet of decorative insert bodies.
Figure 11:
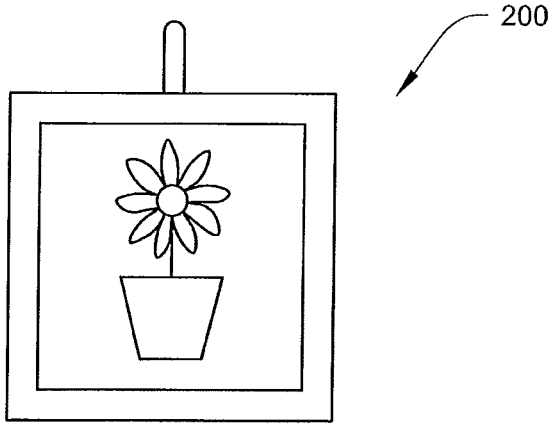
FIG. 11 is a front view of another exemplary embodiment of jewelry apparatus.
Figure 12:
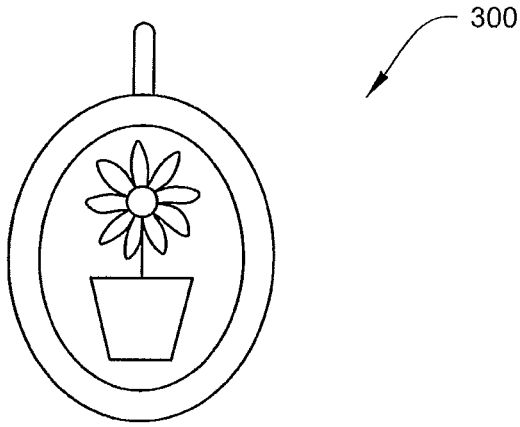
FIG. 12 is a front view of still another exemplary embodiment of jewelry apparatus.
Figure 13:
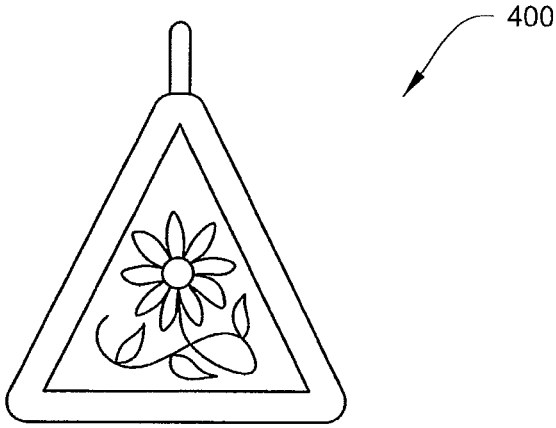
FIG. 13 is a front view of yet still another exemplary embodiment of jewelry apparatus.

The decorative insert body 150 may be formed as part of a plurality of decorative insert bodies formed as a part of a sheet 190 as shown in FIG. 10. In other words, multiple decorative insert bodies 150 may be formed on sheet 190. In this embodiment, sheet 190 includes forty-two decorative insert bodies 150 in a 7 by 6 configuration. In other embodiments, the sheet 190 may include more or less insert bodies in alternative arrangements depending on size and/or shape. In the embodiment depicted, the decorative insert bodies 150 of the sheet 190 are alternating between two different ornamentations. In other embodiments, however, each decorative insert body 150 of the sheet 190 may include the same ornamentation or different ornamentations. In still other embodiments, the sheet 190 may include rows of decorative insert bodies 150 each including the same ornamentation or any other combination and/or arrangement of ornamentations.

The sheet 190 may be formed, e.g., the layers of the sheet 190 may be coupled together, before each decorative insert body 150 is cut (e.g., die cut) from the sheet 190. In at least one embodiment, a 12-inch by 18-inch sheet 190 may be formed using a color litho-dry-erase/matte laminate process on a 30 mil magnet material sheet (e.g., the first layer 160). Such color litho-dry-erase/matte laminate process increases the overall thickness to about 38 mil.

In one or more embodiments, the decorative insert bodies 150 may be separated from the sheet 190 utilizing various techniques, e.g., scoring and breaking, stamping, die cutting, etc.

FIGS. 11-15 depict alternate jewelry apparatus configurations. Jewelry apparatus 200, 300, & 400 are similar to jewelry apparatus 100 as described herein but have a square shape, oval shape, and triangular shape, respectively. Jewelry apparatus 500 is similar to jewelry apparatus 100 as described herein but the receiving portion is coupled to a ring. Jewelry apparatus 600 is similar to jewelry apparatus 100 as described herein but includes two receiving portions coupled to a bracelet (or anklet) and two decorative insert bodies. Further, the jewelry apparatus described herein may be incorporated into other jewelry such as, e.g., earrings, charm bracelets, eyeglass frames, belt buckles, buttons, cuff links, and/or watch bands.

The complete disclosure of the patents, patent documents, and publications cited in the Background, the Detailed Description of Exemplary Embodiments, and elsewhere herein are incorporated by reference in their entirety as if each were individually incorporated.

Illustrative embodiments of this invention are discussed and reference has been made to possible variations within the scope of this invention. These and other variations, combinations, and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof.

What is claimed is:

1. Method of providing jewelry apparatus comprising:

providing a sheet of magnetic material comprising a plurality of decorative insert bodies, wherein the plurality of decorative insert bodies are separable from one another, wherein each decorative insert body of the plurality of decorative insert bodies comprises:

a substantially flat front surface, a rear surface located opposite the front surface, and at least one side surface forming a perimeter of the decorative insert body; and providing a receiving portion defining an opening configured to receive a decorative insert body of the plurality of decorative insert bodies, wherein the receiving portion comprises:

a rear portion comprising a receiving surface defining a bottom of the opening configured to contact at least a portion of the rear surface of the decorative insert body, wherein the rear portion of the receiving portion comprises a non-magnetized ferromagnetic material, and further wherein the rear portion holds the decorative insert body in position within the opening by attraction between the magnetic material of the decorative insert body and the non-magnetized ferromagnetic material of the rear portion, and a frame portion comprising a front framing surface about the perimeter of the decorative insert body when received in the opening and at least one side surface defining the opening configured to receive the decorative insert body, wherein the at least one side surface corresponds to the perimeter of the decorative insert body so as to restrict lateral movement of the decorative insert body within the opening when the decorative insert body is received therein, wherein the sheet of magnetic material defines a thickness between the front surfaces and the rear surfaces of the plurality of decorative insert bodies, and wherein a depth of the opening of the receiving portion is equal to or greater than the thickness of the sheet of material.

2. The method of claim 1, wherein the sheet of magnetic material is die cut such that the plurality of decorative insert bodies are separable from one another.

3. The method of claim 1, wherein the rear surface of each decorative insert body of the plurality of decorative insert bodies is substantially flat, and further wherein the receiving surface of the receiving portion is substantially flat.

4. The method of claim 1, wherein the front surface of each decorative insert body of the plurality of decorative insert bodies comprises ornamentation, wherein the ornamentation of the front surface of each decorative insert body is viewable when the decorative insert body is received within the opening defined by the receiving portion.

5. The method of claim 1, wherein the rear portion of the receiving portion comprises a back surface opposite the receiving surface that lacks protrusions extending therefrom in a direction opposite the receiving surface.

6. The method of claim 1, wherein the rear portion of the receiving portion defines an insert removal opening extending therethrough from a back surface to the receiving surface so as to allow a person to push the decorative insert body out of the opening after being positioned therein so as to permit a same or a different decorative insert body of the plurality of decorative insert bodies to be received within the opening of the receiving portion configured to receive a decorative insert body.

7. The method of claim 1, wherein at least edge portions of the receiving surface of the receiving portion proximate the at least one side surface of the frame portion provide a ferromagnetic interface with the rear surface of the decorative insert body so as to hold the decorative insert body in position within the opening by attraction between the magnetic material of the decorative insert body and non-magnetized ferromagnetic material of the rear portion.

8. The method of claim 1, wherein the rear portion of the receiving portion comprises a rear support portion integral with the frame portion, and wherein the non-magnetized ferromagnetic material comprises a non-magnetized ferromagnetic portion positioned adjacent to the rear support portion, wherein the non-magnetized ferromagnetic portion comprises a substantially flat surface to provide the receiving surface for contact with the rear surface of the decorative insert body.

9. The method of claim 8, wherein the non-magnetized ferromagnetic portion is at least partially adhered to the rear support portion.

10. The method of claim 9, wherein the rear support portion is non-ferromagnetic.

11. The method of claim 1, wherein the opening defined by the receiving portion is a rectangular opening.

12. The method of claim 1, wherein the sheet of magnetic material defines a thickness between the front surfaces and the rear surfaces of the plurality of decorative insert bodies, wherein the thickness is greater than or equal to 1/64 of an inch and less than or equal to 1/4 of an inch.

13. The method of claim 1, wherein the receiving portion further comprises a loop connector coupled to at least one of the frame portion and the rear portion for receiving a chain, wherein the method further comprises providing a chain configured to extend through the loop connector for forming a necklace.

14. The method of claim 1, wherein the receiving portion further comprises a ring portion coupled to at least one of the frame portion and the rear portion configured to receive a user's finger so as to be used as a ring.

15. The method of claim 1, wherein the receiving portion further comprises a bracelet portion coupled to at least one of the frame portion and the rear portion configured to receive a user's wrist so as to be used as a bracelet.

16. Method of providing jewelry apparatus comprising:

providing a sheet of magnetic material comprising a plurality of decorative insert bodies, wherein the plurality of decorative insert bodies are separable from one another, wherein each decorative insert body of the plurality of decorative insert bodies comprises:

a substantially flat front surface, a rear surface located opposite the front surface, and at least one side surface forming a perimeter of the decorative insert body; and providing a receiving portion defining an opening configured to receive a decorative insert body of the plurality of decorative insert bodies, wherein the receiving portion comprises:

a rear portion comprising a receiving surface defining a bottom of the opening configured to contact at least a portion of the rear surface of the decorative insert body and a back surface opposite the receiving surface that lacks protrusions extending therefrom in a direction opposite the receiving surface, wherein the rear portion of the receiving portion comprises a non-magnetized ferromagnetic material, and further wherein the rear portion holds the decorative insert body in position within the opening by attraction between the magnetic material of the decorative insert body and the non-magnetized ferromagnetic material of the rear portion, and a frame portion comprising a front framing surface about the perimeter of the decorative insert body when received in the opening and at least one side surface defining the opening configured to receive the decorative insert body, wherein the at least one side surface corresponds to the perimeter of the decorative insert body so as to restrict lateral movement of the decorative insert body within the opening when the decorative insert body is received therein.

17. Method of providing jewelry apparatus comprising:

providing a sheet of magnetic material comprising a plurality of decorative insert bodies, wherein the plurality of decorative insert bodies are separable from one another, wherein each decorative insert body of the plurality of decorative insert bodies comprises:

a substantially flat front surface, a rear surface located opposite the front surface, and at least one side surface forming a perimeter of the decorative insert body; and providing a receiving portion defining an opening configured to receive a decorative insert body of the plurality of decorative insert bodies, wherein the receiving portion comprises:

a rear portion comprising a receiving surface defining a bottom of the opening configured to contact at least a portion of the rear surface of the decorative insert body, wherein the rear portion of the receiving portion defines an insert removal opening extending therethrough from a back surface to the receiving surface so as to allow a person to push the decorative insert body out of the opening after being positioned therein so as to permit a same or a different decorative insert body of the plurality of decorative insert bodies to be received within the opening of the receiving portion configured to receive a decorative insert body, wherein the rear portion of the receiving portion comprises a non-magnetized ferromagnetic material, and further wherein the rear portion holds the decorative insert body in position within the opening by attraction between the magnetic material of the decorative insert body and the non-magnetized ferromagnetic material of the rear portion, and a frame portion comprising a front framing surface about the perimeter of the decorative insert body when received in the opening and at least one side surface defining the opening configured to receive the decorative insert body, wherein the at least one side surface corresponds to the perimeter of the decorative insert body so as to restrict lateral movement of the decorative insert body within the opening when the decorative insert body is received therein.

18. Method of providing jewelry apparatus comprising:

providing a sheet of magnetic material comprising a plurality of decorative insert bodies, wherein the plurality of decorative insert bodies are separable from one another, wherein each decorative insert body of the plurality of decorative insert bodies comprises:

a substantially flat front surface, a rear surface located opposite the front surface, and at least one side surface forming a perimeter of the decorative insert body; and providing a receiving portion defining an opening configured to receive a decorative insert body of the plurality of decorative insert bodies, wherein the opening defined by the receiving portion is a rectangular opening, wherein the receiving portion comprises:

a rear portion comprising a receiving surface defining a bottom of the opening configured to contact at least a portion of the rear surface of the decorative insert body, wherein the rear portion of the receiving portion comprises a non-magnetized ferromagnetic material, and further wherein the rear portion holds the decorative insert body in position within the opening by attraction between the magnetic material of the decorative insert body and the non-magnetized ferromagnetic material of the rear portion, and a frame portion comprising a front framing surface about the perimeter of the decorative insert body when received in the opening and at least one side surface defining the opening configured to receive the decorative insert body, wherein the at least one side surface corresponds to the perimeter of the decorative insert body so as to restrict lateral movement of the decorative insert body within the opening when the decorative insert body is received therein.

19. Method of providing jewelry apparatus comprising:

providing a sheet of magnetic material comprising a plurality of decorative insert bodies, wherein the plurality of decorative insert bodies are separable from one another, wherein each decorative insert body of the plurality of decorative insert bodies comprises:

a substantially flat front surface, a rear surface located opposite the front surface, wherein the sheet of magnetic material defines a thickness between the front surfaces and the rear surfaces of the plurality of decorative insert bodies, wherein the thickness is greater than or equal to 1/64 of an inch and less than or equal to 1/4 of an inch, and at least one side surface forming a perimeter of the decorative insert body; and providing a receiving portion defining an opening configured to receive a decorative insert body of the plurality of decorative insert bodies, wherein the receiving portion comprises:

a rear portion comprising a receiving surface defining a bottom of the opening configured to contact at least a portion of the rear surface of the decorative insert body, wherein the rear portion of the receiving portion comprises a non-magnetized ferromagnetic material, and further wherein the rear portion holds the decorative insert body in position within the opening by attraction between the magnetic material of the decorative insert body and the non-magnetized ferromagnetic material of the rear portion, and a frame portion comprising a front framing surface about the perimeter of the decorative insert body when received in the opening and at least one side surface defining the opening configured to receive the decorative insert body, wherein the at least one side surface corresponds to the perimeter of the decorative insert body so as to restrict lateral movement of the decorative insert body within the opening when the decorative insert body is received therein.

20. Method of providing jewelry apparatus comprising:

providing a sheet of magnetic material comprising a plurality of decorative insert bodies, wherein the plurality of decorative insert bodies are separable from one another, wherein each decorative insert body of the plurality of decorative insert bodies comprises:

a substantially flat front surface, a rear surface located opposite the front surface, and at least one side surface forming a perimeter of the decorative insert body; and providing a receiving portion defining an opening configured to receive a decorative insert body of the plurality of decorative insert bodies, wherein the receiving portion comprises:

a rear portion comprising a receiving surface defining a bottom of the opening configured to contact at least a portion of the rear surface of the decorative insert body, wherein the rear portion of the receiving portion comprises:

a rear support portion integral with a frame portion, and a non-magnetized ferromagnetic portion positioned adjacent to the rear support portion, wherein the non-magnetized ferromagnetic portion comprises a substantially flat surface to provide the receiving surface for contact with the rear surface of the decorative insert body, and wherein the frame portion comprises a front framing surface about the perimeter of the decorative insert body when received in the opening and at least one side surface defining the opening configured to receive the decorative insert body, wherein the at least one side surface corresponds to the perimeter of the decorative insert body so as to restrict lateral movement of the decorative insert body within the opening when the decorative insert body is received therein, wherein the receiving portion further comprises at least one of a loop connector coupled to at least one of the frame portion and the rear portion for receiving a chain, a ring portion coupled to at least one of the frame portion and the rear portion configured to receive a user's finger so as to be used as a ring, and a bracelet portion coupled to at least one of the frame portion and the rear portion configured to receive a user's wrist so as to be used as a bracelet.

* * * * *